US005336528A

United States Patent [19]

Bohme

[11] Patent Number: 5,336,528

[45] Date of Patent: Aug. 9, 1994

[54] HEAT SEALABLE PAPER AND METHOD FOR ITS MANUFACTURE

[75] Inventor: Reinhard D. Bohme, Riegelsville, Pa.

[73] Assignee: James River Paper Company, Inc., Milford, Ohio

[21] Appl. No.: 3,995

[22] Filed: Jan. 15, 1993

[51] Int. Cl.[5] ..... B65D 3/12

[52] U.S. Cl. ..... 427/361; 427/362; 427/365; 427/366; 427/391; 428/348; 428/349

[58] Field of Search ..... 427/361, 362, 365, 366, 427/391; 428/348, 349

[56] References Cited

U.S. PATENT DOCUMENTS 2,912,347 11/1959 Yezek et al. ..... 427/362
4,620,992 11/1986 Nojima et al. ..... 427/362
4,631,308 12/1986 Graham et al. ..... 524/272
4,900,583 2/1990 Hirabayashi et al. ..... 427/362 X
4,981,758 1/1991 Chu et al. ..... 428/516

*Primary Examiner*—Michael Lusignan
*Attorney, Agent, or Firm*—Stanley M. Teigland

[57] ABSTRACT

Heat sealable paper can be prepared by applying to a surface-sized paper web a coating of a dispersion comprising a microcrystalline wax and a copolymer of ethylene and acrylic acid or methacrylic acid. The coating can be applied by means of a size press between dryer sections in a paper machine. The coating neither adheres to nor leaves a residue on the heated drums in the dryer section following the size press.

11 Claims, No Drawings

HEAT SEALABLE PAPER AND METHOD FOR ITS MANUFACTURE

This invention is a method of manufacturing paper having a coating of heat sealable material. The invention also includes the paper made by this method.

Heat sealable paper is generally made by extruding onto a paper web a heat sealable coating comprising a wax and a copolymer of ethylene and acrylic acid or methacrylic acid, as disclosed in U.S. Pat. No. 4,631,308 to Graham et al. Heat sealable paper has also been made by applying to a paper web a coating of an aqueous emulsion of a wax and a copolymer of ethylene and acrylic acid or methacrylic acid. However, such coatings, as conventionally formulated, are dried by noncontact methods because the coatings would stick to or leave excessive residue on contact drying means, such as heated drums.

This invention provides a method of making heat sealable paper wherein a coating of an aqueous dispersion applied to the paper can be dried by passing the coated web over the surface of a heated drum without having the coating adhere to or leave excessive residue on the drum.

The aqueous dispersion of the invention comprises a wax having a melting point of at least about 80 degrees C. (176 degrees F.) and a copolymer which is a copolymer of ethylene and a comonomer which is acrylic acid or methacrylic acid. As used here, the term "copolymer" includes a mixture of such copolymers.

The wax is preferably a microcrystalline wax. Microcrystalline waxes typically have a melting point between about 87 and 91 degrees C. Paraffin wax, which typically has a melting point between about 47 and 65 degrees C., is not suitable because coatings of dispersions containing paraffin wax tend to stick to the heated drums when the coatings contact the drums. Synthetic polyethylene wax may be suitable. The ratio of the wax to the copolymer is preferably between about 1:4 to about 1:19, more preferably between about 1:4 to 1:10.

The copolymer is preferably ethylene-acrylic acid copolymer or ethylene-methacrylic acid copolymer. When the copolymer is ethylene-acrylic acid copolymer it preferably has an acid number of from about 125 to 187, which corresponds to an acrylic acid content of about 16 to 24 percent by weight. When the copolymer is ethylene-methacrylic acid copolymer, it preferably has an acid number between about 77 and 130, which corresponds to a methacrylic acid content of about 12 to 20 percent by weight. The dispersion preferably contains a mixture of the two copolymers wherein the ratio of the ethylene-methacrylic acid copolymer to the ethylene-acrylic acid copolymer is from about 1:0.1 to about 1:6. Copolymers that are ionomers may also be suitable.

The dispersion may be formed by simply mixing a commercially available aqueous dispersion of the wax with a commercially available aqueous dispersion of the copolymer. The resulting dispersion preferably contains about 70 to 75 percent water and preferably has a viscosity between about 50 and 250 cps.

The dispersion is preferably applied to a paper web that has been surface sized to provide holdout of the dispersion, which forms the heat sealable coating. Any surface size conventionally used to provide a good holdout of aqueous and polymeric coatings can be used. The surface size preferably contains, in addition to a typical converted starch or other film-former, such as polyvinyl alcohol, other sizing agents that impede permeation of water, such as a rosin derivative, an alkylketene dimer, or styrene-maleic anhydride copolymer. The surface size is preferably applied by means of a size press that is between first and second dryer sections of a paper machine.

The emulsion is preferably applied to the surface-sized paper by means of a size press. The rate of application is preferably between about 1 and 2 grams per square meter (0.75 to 1.5 pounds per 3000 square feet) per side. The size press is preferably located between dryer sections of a paper machine, with the upstream dryer section being the dryer section that follows the size press by which the surface size is applied. Each dryer section consists of heated rolls or drums over which the paper is passed, with each surface of the paper contacting alternating drums in the dryer section. The temperature of the drums is preferably between about 90 and 140 degrees C. As the coated paper of this invention is passed over the drums, it does not substantially adhere to the drums or leave a substantial residue. The drums may be coated with a release agent, such as polytetrafluoroethylene, but even in the case of uncoated drums the coating does not stick to the drums or leave a substantial residue. This is surprising considering that the coating is a heat activatable adhesive and that conventional heat sealable coatings have been found to stick to the drums and leave substantial residue.

An advantage of this invention is that the heat sealable paper can be made in-line in a paper machine using a size press located between dryer sections of the paper machine. Hence, neither off-line coaters nor noncontact dryers are required to manufacture the paper. Another advantage is that, in its preferred embodiments, the heat sealable paper is repulpable because the wax and copolymer are dispersable in water at moderate alkaline pH.

The following example illustrates the best mode contemplated for practicing the invention.

EXAMPLE

A heat sealable paper was prepared on a paper machine having two size presses, with each size press being between dryer sections consisting of a series of drums heated to a temperature of about 95° C. The paper was surface sized by means of the first size press using a surface size having solids comprising 80 percent starch (Pengloss 280 from Pennick-Ford), 10 percent clay (KCS clay from Georgia Clay), and 10 percent water repellent additive (Cypress 48 from American Cyanamid). After passing through the dryer section, the surface-sized paper was coated with a dispersion wherein 20 percent of the total solids were microcrystalline wax (Paracol 404G from Hercules), 30 percent were ethylene-methacrylic acid copolymer having an acid number of 90 (Adcote 56220 from Morton International), and 50 percent were ethylene-acrylic acid copolymer having an acid number of 156 (Michem Prime 4938 from Michelman Chemical). The dispersion contained about 72 percent water. When the coated paper was dried in the dryer section the coating did not substantially adhere to the heated drums nor did it leave a substantial residue on the drums. When the resulting heat sealable paper was heat sealed to itself at a temperature of 93 degrees C. (200 degrees F.) and a pressure of 2.8 kg/sq. cm (40 psi), it formed a bond that was stronger than the paper, i.e., greater than about 120 grams/cm. (300 grams/inch).

I claim:

1. A method of making paper having a heat sealable coating, which method comprises:

a) applying to a paper web a coating comprising effective film-forming amounts of an aqueous dispersion of a wax having a melting point of at least about 80 degrees C. and a copolymer of ethylene and a comonomer which is acrylic acid or methacrylic acid, and b) drying the coating by passing the coated web over the surface of a heated drum.

2. The method of claim 1 wherein the wax is a microcrystalline wax.

3. The method of claim 1 wherein the copolymer is ethylene-methacrylic acid copolymer.

4. The method of claim 3 wherein the copolymer has an acid number between about 77 and 130.

5. The method of claim 4 wherein the copolymer is a mixture of the ethylene-methacrylic acid copolymer and an ethylene-acrylic acid copolymer having an acid number between about 125 and 187.

6. The method of claim 5 wherein the ratio of the ethylene-acrylic acid copolymer to the ethylene-methacrylic acid copolymer ranges from about 0.1:1 to about 6:1.

7. The method of claim 1 wherein the ratio of wax to the copolymer is from about 1:4 to about 1:19.

8. The method of claim 1 wherein the coating does not adhere to the drum or leave a substantial residue on the drum.

9. The method of claim 1 wherein the paper has been surface sized prior to the application of the aqueous emulsion to provide holdout of the aqueous emulsion.

10. A method of making paper having a heat sealable coating, which method comprises:

a) applying to a surface-sized paper web an aqueous dispersion of a microcrystalline wax having a melting point of at least 80 degrees C. and a copolymer of ethylene and a comonomer which is acrylic acid or methacrylic acid, with the ratio of the wax to the copolymer being between about 1:4 to about 1:10, and b) drying the coating by passing the coated web over the surface of a heated drum, with the composition of the coating being such that the coating does not adhere to the drum or leave a substantial residue on the drum.

11. The method of claim 10 wherein the copolymer has an acid number between about 77 and 187.

* * * * *